US005551190A

United States Patent [19]

Yamagishi et al.

[11] Patent Number: 5,551,190

[45] Date of Patent: Sep. 3, 1996

[54] SLIDE DOOR DRIVING SYSTEM

[75] Inventors: Jun Yamagishi; Atsushi Kaminaga; Yousuke Goutani, all of Yokohama, Japan

[73] Assignee: Ohi Seisakusho Co., Ltd., Yokohama, Japan

[21] Appl. No.: 216,950

[22] Filed: Mar. 24, 1994

[30] Foreign Application Priority Data

| | | | |
|---|---|---|---|
| May 19, 1993 | [JP] | Japan | 5-026021 |
| May 19, 1993 | [JP] | Japan | 5-117020 |
| May 19, 1993 | [JP] | Japan | 5-117064 |

[51] Int. Cl.[6] ..... E05F 11/00

[52] U.S. Cl. ..... 49/360; 49/280

[58] Field of Search ..... 49/139, 360; 74/625; 296/146.4

[56] References Cited

U.S. PATENT DOCUMENTS

| | | | |
|---|---|---|---|
| 4,617,757 | 10/1986 | Kagiyama et al. | 49/280 |
| 4,640,050 | 2/1987 | Yamagishi et al. | 49/280 |
| 4,984,385 | 1/1991 | DeLand | 49/360 X |
| 5,018,303 | 5/1991 | Koura et al. | 49/280 |
| 5,168,666 | 12/1992 | Koura et al. | 49/360 |
| 5,189,839 | 3/1993 | DeLand et al. | 49/360 |
| 5,263,762 | 11/1993 | Long et al. | 49/360 X |

FOREIGN PATENT DOCUMENTS

| | | |
|---|---|---|
| 3526761 | 2/1986 | Germany . |
| 3538837 | 5/1986 | Germany . |
| 2-150377 | 12/1990 | Japan . |
| 3-248914 | 11/1991 | Japan . |

OTHER PUBLICATIONS

Hida, *Controller for Vehicle On-off Member,* Patent Abstracts of Japan, Apr. 19, 1990, vol. 14, No. 193.

*Primary Examiner*—Jerry Redman
*Attorney, Agent, or Firm*—Foley & Lardner

[57] ABSTRACT

A slide door driving system of a motor vehicle comprises an electric power source and a door driving device to move the slide door between a full-open position and a full-close latched position with an aid of electric power from the electric power source. A manual switch is mounted in the motor vehicle. A control circuit is used for controlling the door driving device in accordance with operation of the manual switch. A so-called "permission switch" is connected to the control circuit. The permission switch is turned ON when an ignition switch for an engine of the vehicle is turned ON. The control circuit is provided with a judging circuit which makes an operation of the manual switch operative only when the operation of the manual switch is carried out under a condition wherein the permission switch is kept ON.

3 Claims, 13 Drawing Sheets

SLIDE DOOR DRIVING SYSTEM

BACKGROUND OF THE INVENTION

1. Field of the Invention

The present invention relates in general to driving systems of doors, and more particularly to driving systems of automotive slide doors. More specifically, the present invention is concerned with driving systems for such slide doors, which drive, with an aid of electric power, the slide door in opening/closing direction in response to a manual operation of a control switch.

2. Description of the Prior Art

Hitherto, in wheeled motor vehicles, particularly in the field of microbus, one-box car, commercial van and the like, various types of power drive slide doors have been proposed and put into practical use. These slide doors are driven or controlled by door driving systems with an aid of electric power.

Some of conventional driving systems for such automotive slide doors are described in Japanese Utility Model First Provisional Publication 2-150377 and Japanese Patent First Provisional Publication 3-248914, which, upon manipulation of a control switch positioned near a driver's seat, force the slide door to move in opening or closing direction with an aid of electric power supplied from a battery. However, due to the inherent construction, the conventional slide door driving systems have some drawbacks which are, for example, troublesome assembling procedure, wasteful power consumption, poor reliability in operation and safety, etc.,.

SUMMARY OF THE INVENTION

It is therefore an object of the present invention to provide a driving system of an automotive slide door, which is free of the above-mentioned drawbacks.

According to a first aspect of the present invention, there is provided a slide door driving system of a motor vehicle. The system comprises an electric power source; a door driving device to move the slide door between a full-open position and a full-close latched position with an aid of electric power from the electric power source; a manual switch mounted in the motor vehicle; a control circuit for controlling the door driving device in accordance with operation of the manual switch; and a permission switch connected to the control circuit, the permission switch being turned ON when an ignition switch for an engine of the vehicle is turned ON; wherein the control circuit is provided with a judging circuit which makes an operation of the manual switch operative only when the operation is carried out under a condition wherein the permission switch is kept ON.

According to a second aspect of the present invention, there is provided an arrangement in a motor vehicle having a slide door which slides forward and rearward along a side wall of a vehicle body to close and open a door opening defined by the side wall. The arrangement comprises a step portion of the vehicle body, the step portion defining a lower wall of the door opening; a side sill of the vehicle body, the side sill extending under the step portion with a given clearance defined therebetween; a step bracket installed in the given clearance and supported by the side sill; drive and driven pulleys mounted to a lower surface of the step bracket; a power unit mounted to the lower surface of the step bracket to drive the drive pulley; an endless belt put around the drive and driven pulleys, so that when the drive pulley is driven by the power unit, the endless belt runs around the drive and driven pulleys; and a belt arm having one end pivotally connected to the endless belt and the other end connected to the slide door.

According to a third aspect of the present invention, there is provided a motor vehicle which comprises a slide door; a door driving unit for driving, with an aid of electric power, the slide door forward and rearward along a side wall of the vehicle to close and open a door opening defined by the side wall; a door lock device mounted to the slide door and having a latch plate, the latch plate being engageable with a striker secured to the vehicle body thereby to latch the slide door at a closed position of the door; a half-latch condition detecting switch which issues an information signal when detecting a half-latch condition of the door lock device; a step bracket fixed to the vehicle body at a position below a step portion of a door opening of the vehicle, the step bracket having a lower surface to which the door driving unit is mounted; a door closing unit incorporated with the latch plate of the door lock device, the door closing unit forcing the latch plate to pivot toward a full-latch position upon issuance of the information signal from the half-latch condition detecting switch; a lock canceling unit incorporated with the door lock device, the lock canceling unit being capable of canceling the latched engagement between the latch plate and the striker; a manual switch unit arranged near a driver's seat, the manual switch unit including open and close switches; and a control circuit for controlling the door driving unit, the door closing unit and the lock canceling unit in accordance with a manual operation applied to the manual switch unit.

BRIEF DESCRIPTION OF THE DRAWINGS

Other objects and advantages of the present invention will become apparent from the following description when taken in conjunction with the accompanying drawings, in which.

DETAILED DESCRIPTION OF THE INVENTION

Figure 1:
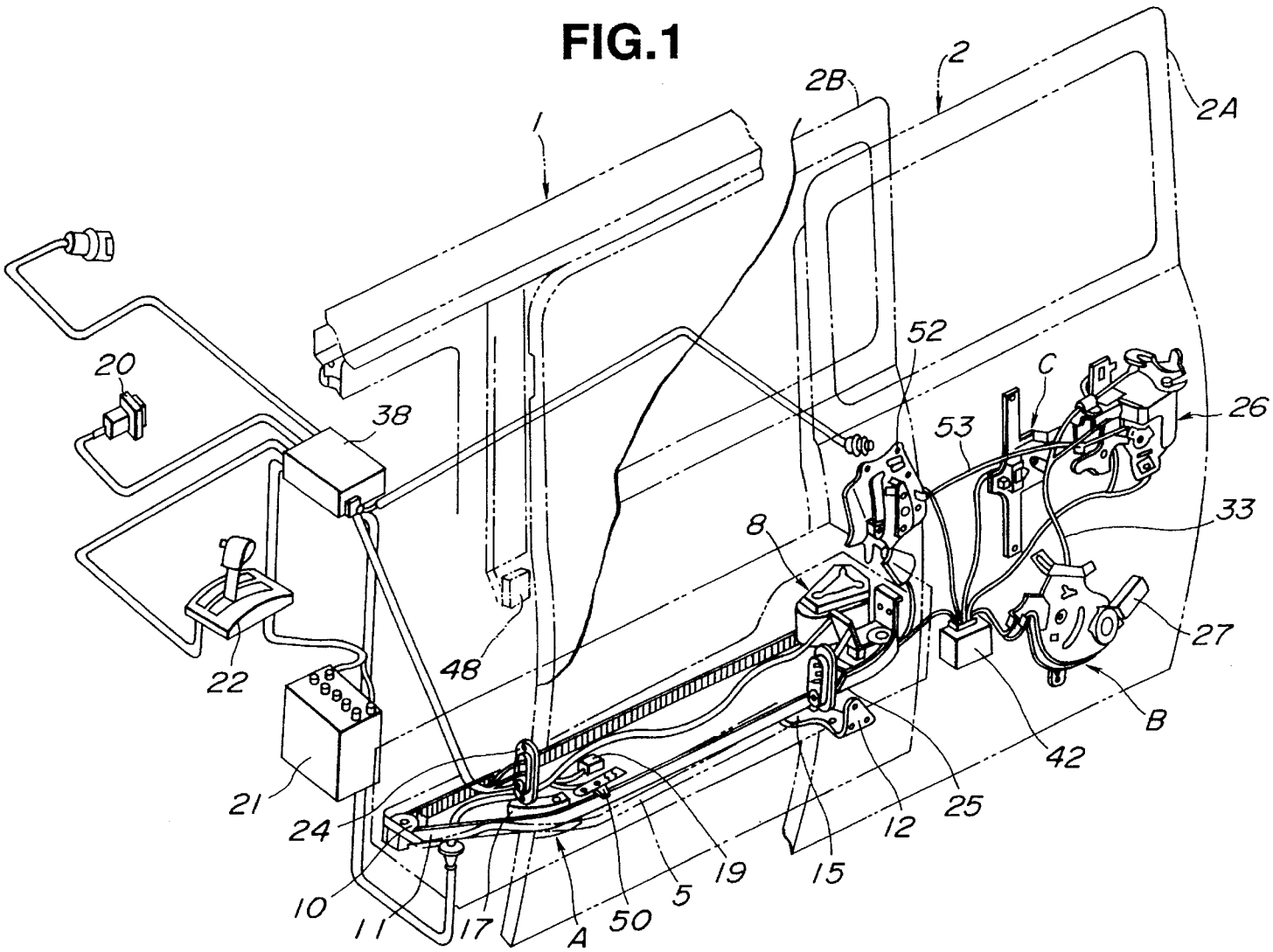
FIG. 1 is a sketch of one side portion of a one-box type motor vehicle, to which a driving system of a slide door, according to the present invention, is practically mounted.

Referring to FIG. 1 of the drawings, there is schematically shown a slide door driving system of a one-box type motor vehicle, which is an embodiment of the present invention.

In the drawing, denoted by numeral 1 is a body of the motor vehicle, and denoted by numeral 2 is a slide door which is arranged on a side wall of the body 1 and slides forward and rearward to close and open a door opening defined by the side wall of the vehicle body 1.

Figure 8:
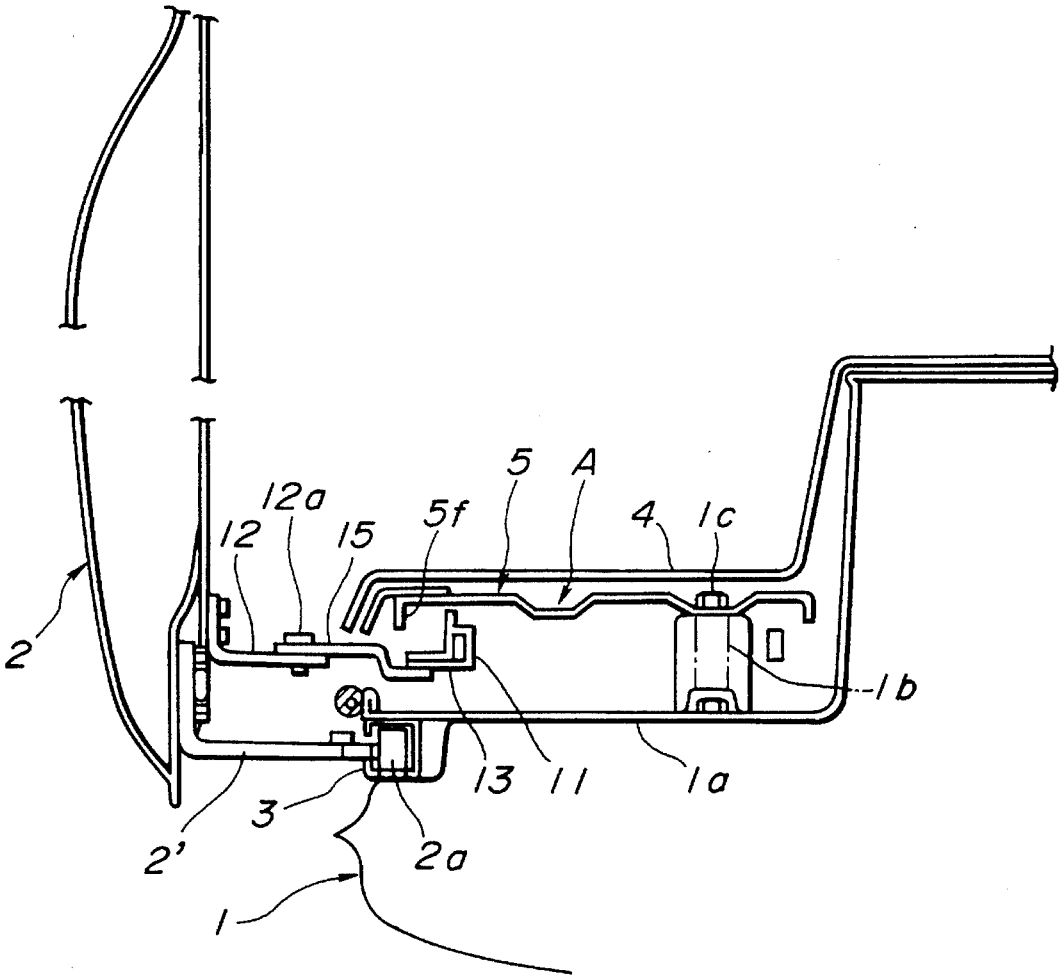
FIG. 8 is a sectional view of one side wall of a motor vehicle to which the slide door driving system of the invention is practically applied.

As will be understood from FIG. 8, a door bracket 2' extends laterally inward from a lower front portion of the door 2 toward the side wall of the vehicle body 1. The door bracket 2' has two rollers **2*a* rotatably guided by a lower guide rail 3 which is secured to a lower side portion of the vehicle body 1**.

The lower guide rail 3 has a front portion curved inward, that is, toward the center of the vehicle body 1, so that, as is seen from FIG. 1, during movement of the door 2 from a full open rear position as denoted by reference 2A to a full close front position as denoted by reference 2B, the door 2 is somewhat shifted laterally inward, that is, toward the center of the vehicle body 1 at its final closing stage.

Although not shown in the drawings, in addition to the lower guide rail 3, an upper guide rail and a waist or rear guide rail are further arranged, which are secured to upper and waist portions of the vehicle body 1 for guiding rollers (not shown) carried by the slide door 2. The arrangement of these guide rails and that of the associated guided rollers are shown, for example, in the above-mentioned 3-248914 publication.

As shown in FIG. 8, the vehicle body 1 has a step portion 4 which constitutes a lower flat wall of the door opening.

Installed under the step portion 4 is a door driving unit (A) which functions to drive the slide door 2 between the full open rear position 2A and an almost close position just before the full-close front position 2B with an aid of electric power.

Figure 7:
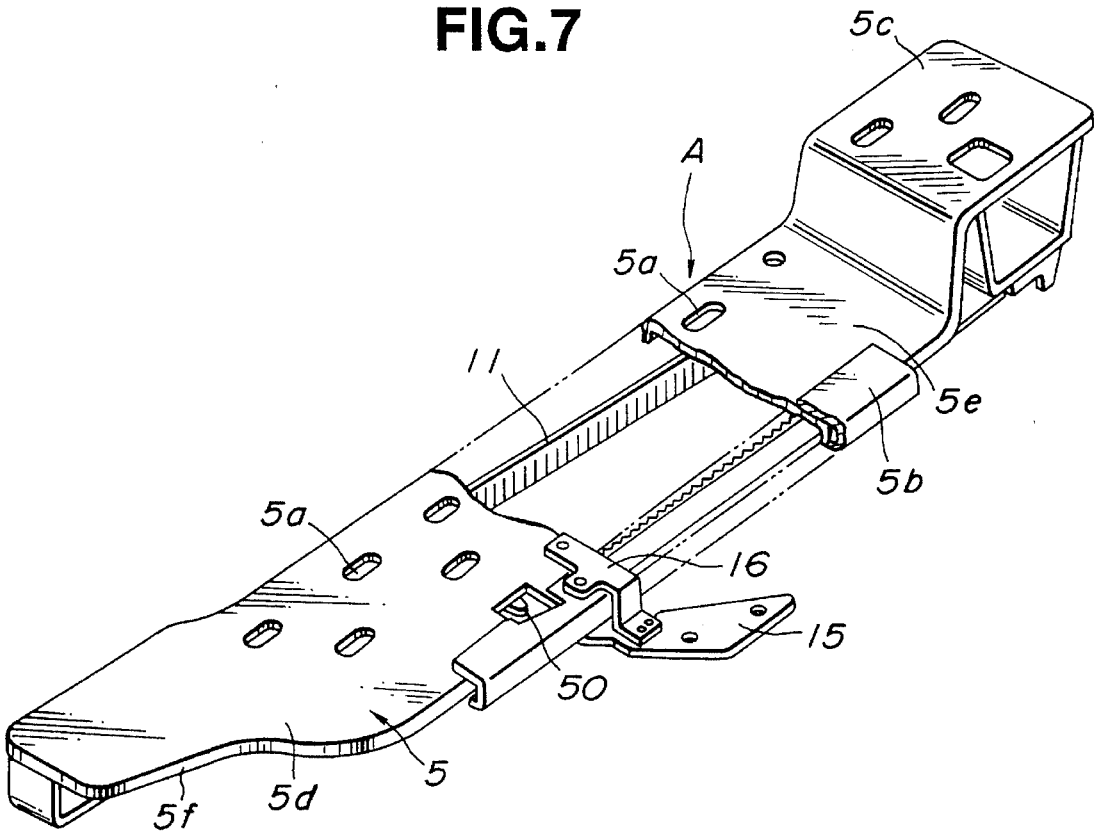
FIG. 7 is a partially cut perspective view of the step bracket to which the door sliding unit is mounted.

As will be understood from FIGS. 7 and 8, the door driving unit (A) comprises a step bracket 5 (see FIG. 7) which is mounted on supporting studs **1*b* raised from a side sill 1*a* of the vehicle body 1. The side sill 1*a*, extends under the step portion 4 with a certain clearance defined therebetween. As is seen from FIG. 7, the step bracket 5 has a raised rear part 5*c***.

Figure 14:
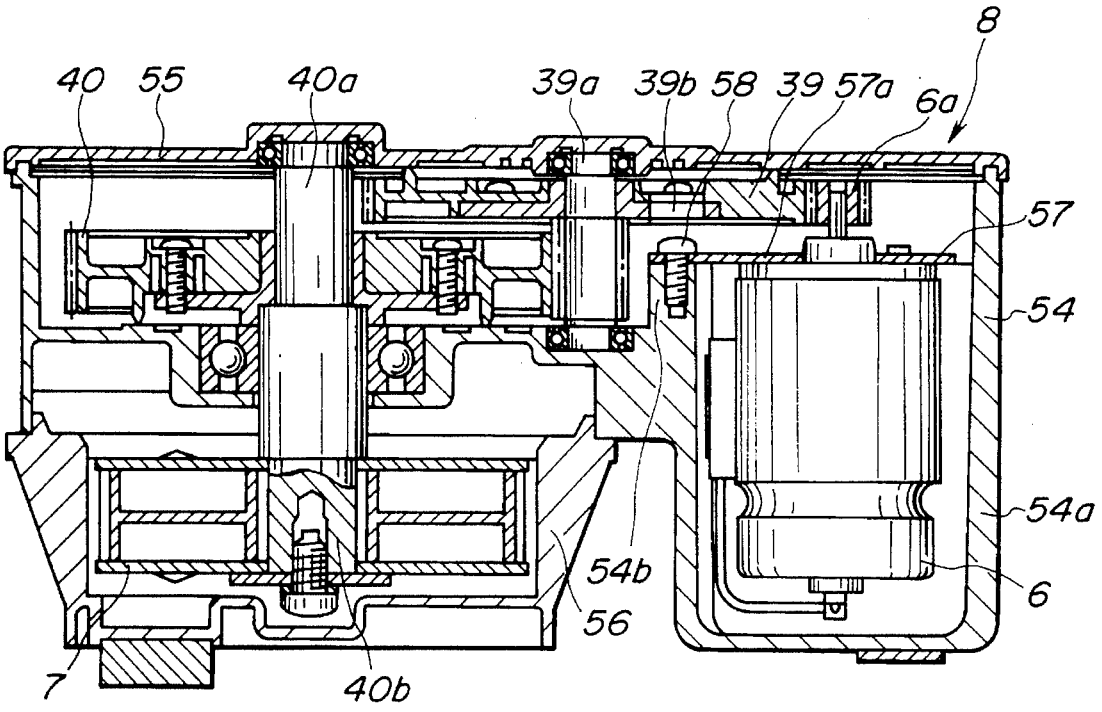
FIG. 14 is a sectional view taken along the line Y—Y of FIG. 13.

Within the raised rear part **5*c*, there is installed a power unit 8 (see FIG. 5) which comprises a toothed drive pulley 7 driven by a reversible electric motor 6 (see FIG. 14). As will be understood from FIG. 7, a toothed endless belt 11 is arranged beneath the step bracket 5, which is, as is seen from FIG. 5, put around the toothed drive pulley 7, a rear idle pulley 9 and a front idle pulley 10 which are rotatably connected to the lower surface of the step bracket 5. The rear idle pulley 9 is positioned near the drive pulley 7 and the front idle pulley 10 is positioned at a front end of the step bracket 5. Thus, upon rotation of the drive pulley 7, the endless belt 11 runs forward or backward around these pulleys 11, 9 and 10**.

It is to be noted that each of the front and rear idle pulleys 10 and 9 has no teeth formed thereon. That is, under running of the endless belt 11, the toothed side of the belt 11 is frictionally put on the smoothed cylindrical outer surface of each idle pulley 10 or 9.

Figure 5:
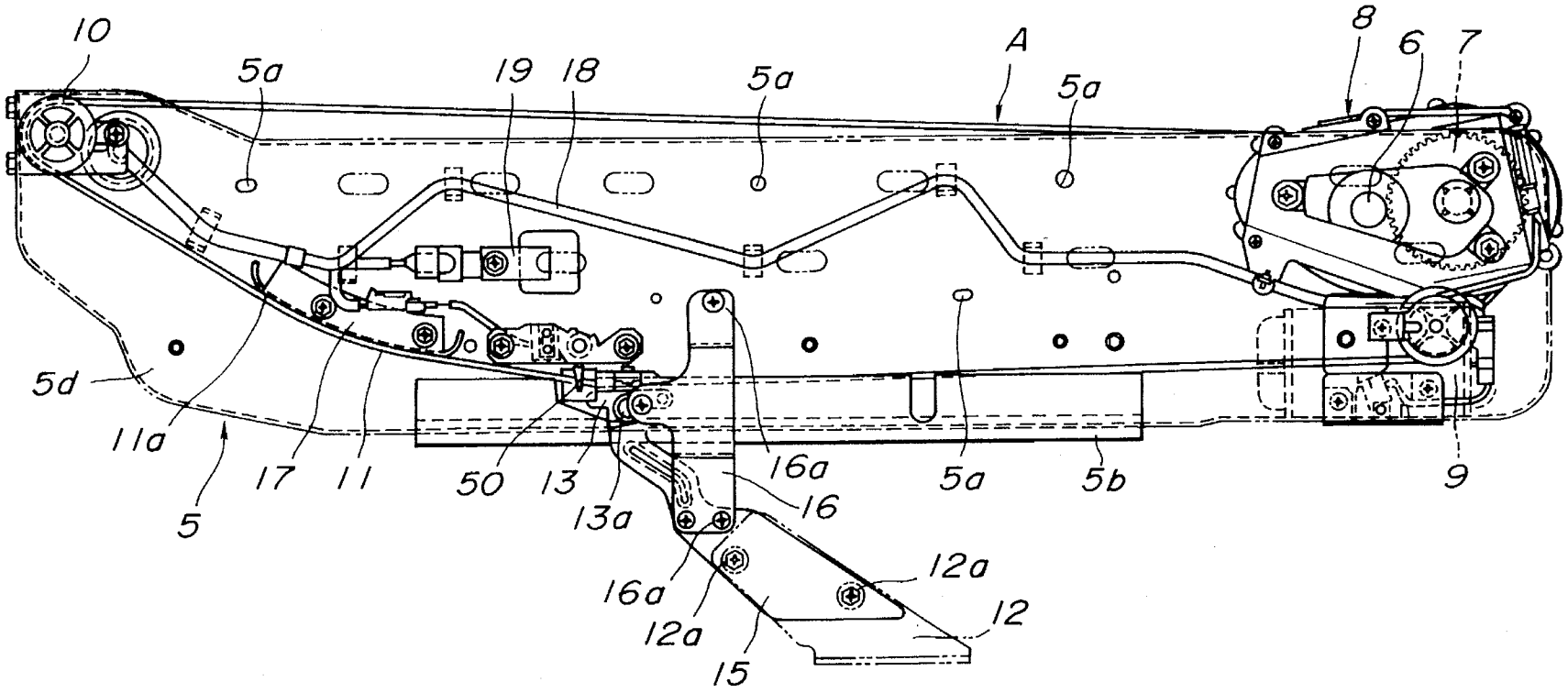
FIG. 5 is a bottom view of the step bracket with parts mounted to a lower surface of the step bracket.
Figure 6:
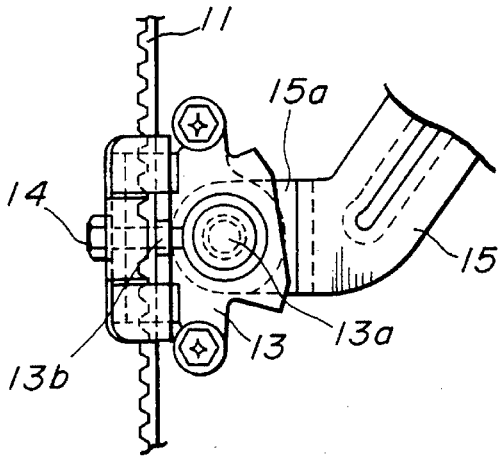
FIG. 6 is a plan view of an essential portion of a belt arm connector.

As is best seen from FIG. 5, the endless belt 11 has, at one major part facing the outside of the vehicle, a belt arm connector 13 fixed thereto through a screw 14 (see FIG. 6). As is seen from FIGS. 5 and 6, a base portion **15*a* of a belt arm 15 is pivotally connected to the belt arm connector 13 through a pivot shaft 13*a***.

As is seen from FIG. 8, the belt arm 15 is connected through bolts **12*a* to a door bracket 12 which extends from the slide door 2**.

As is seen from FIG. 7, the step bracket 5 has a wall **5*f* extending therearound. The step bracket 5 has a longitudinally extending straight part 5*e* which is reinforced by an elongate channel member 5*b*. As will become apparent hereinafter, when the belt arm 15 moves from a rear end of the straight part 5*e* to a front end of the same, the slide door 2 is moved from the full-open rear position 2A to a half-open position at which the door 2** halfly or incompletely opens the door opening.

As is seen from FIGS. 5 and 7, the step bracket 5 is formed at its front part with a front step portion **5*d* which projects outward beyond a front oblique part 11*a* of the endless belt 11. The front oblique part 11*a* is the part of the belt 11, which extends between the front end of the straight part 5*e* and the front idle pulley 10**.

Figure 13:
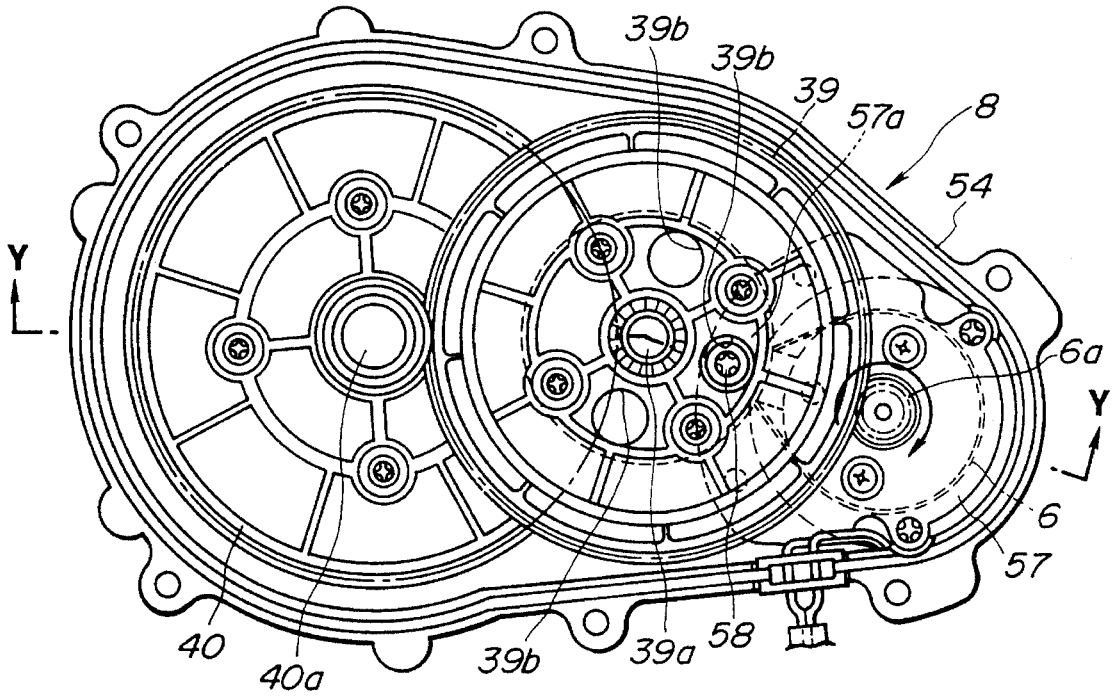
FIG. 13 is a plan view of a power device employed in the door driving unit with a cover removed.
Figure 15:
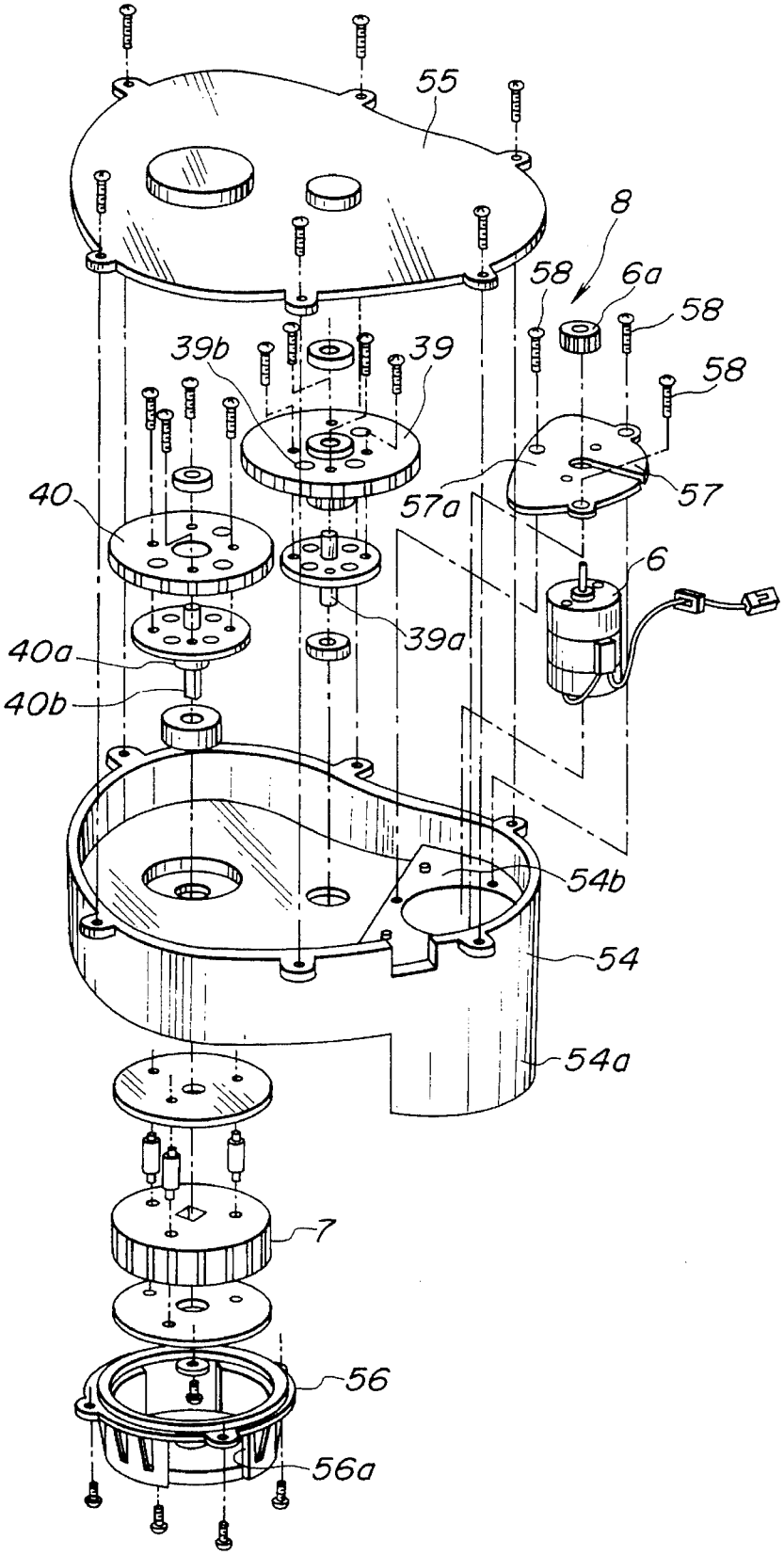
FIG. 15 is an exploded view of the power device of the door driving unit.

As is well shown in FIGS. 13, 14 and 15, the power unit 8 comprises a housing 54. Within a motor receiving bore **54*a* of the housing 54, there is installed the electric motor 6. An output shaft of the motor 6 has a pinion 6*a* secured thereto. Engaged with the pinion 6*a* is a first gear 39 which is pivotally connected through a shaft 39*a* to the housing 54. Engaged with the first gear 39 is a second gear 40 which is pivotally connected through a shaft 40*a* to the housing 54. The shaft 40*a* has a polygonal lower part 40*b* exposed to the lower side of the housing 54. The afore-mentioned drive pulley 7 is secured to the polygonal lower part 40*b* to rotate therewith. An upper opening of the housing 54 is closed by a cover 55. A pulley cover 56 is secured to a lower portion of the housing 54 to cover the drive pulley 7. As is understood from FIG. 15, the pulley cover 56 is formed with slots 56*a* through which the endless belt 11 passes for assured engagement between the teeth of the drive pulley 7 and those of the endless belt 11. The first gear 39, the second gear 40 and their associated parts thus constitute a speed reduction mechanism which can greatly reduce the rotation speed of the drive pulley 7 as compared with that of the output shaft of the motor 6. The speed reduction mechanism is so constructed that when, under deenergization of the electric motor 6, the drive pulley 7 is forced to rotate by an external force, the output shaft of the motor 6** is permitted to rotate.

As is seen from FIGS. 13 and 15, the first gear 39 is formed, about a center bore for the shaft **39*a*, with three work apertures 39*b*. As will be understood from FIG. 14, when the first gear 39 is turned to a certain position, one of the three work apertures 39*b* can be positioned just above a given part of a fixing structure 54*b* defined by the housing 54**. The given part is formed with a threaded bore for the purpose which will become clear hereinafter.

To the fixing structure **54*b*, there is fixed a motor supporting bracket 57 through three connecting screws 58 (see FIG. 15). The motor 6 in the motor receiving bore 54*a* of the housing 54 is secured to the supporting bracket 57 through two bolts. Designated by reference numeral 57*a* is a base part of the supporting bracket 57, which is to be placed on the given part of the fixing structure 54***b* of the housing 54.

As is seen from FIG. 15, the supporting bracket 57 is formed with three openings (no numerals) one of which is positioned at the base part 57*a*. These three openings are somewhat larger in diameter than screws 58.

Assembly of the power unit 8 is carried out in the following manner.

First, the motor 6 is secured to the motor supporting bracket 57, and then the supporting bracket 57 is loosely connected through the three screws 58 to the housing 54. That is, one of the screws 58 passes through-the opening of the base part 57*a* and loosely engages with the threaded bore of the given part of the fixing structure 54*b*, and the other two screws 58 pass through the other two openings of the supporting bracket 57 and loosely engage with two threaded bores formed in an upper flat part of the motor receiving bore 54*a*. Then, the first and second gears 39 and 40 are put into the housing 54 keeping meshed engagement therebetween. With this, a part of the first gear 39 covers the base part 57*a* of the supporting bracket 57. Then, the first gear 39 is slightly turned to the certain position where one of the work apertures 39*b* of the first gear 39 is positioned just above the screw 58 of the base part 57*a*. Then, the motor supporting bracket 57 is manually moved to a right position where a proper engagement between the first gear 39 and the pinion 6*a* of the motor 6 is achieved. The movement of the motor supporting bracket 57 is permitted due to the somewhat larger size of the openings of the supporting bracket 57 than the associated screws 58. Then, the screw 58 of the base part 57*a* of the supporting bracket 57 is fastened by a suitable screw driver (not shown) inserted through the aperture 39*b* of the first gear 39. Then, the other two screws 58 are fastened by the screw driver from the outside. With this procedure, the motor 6 and the first and second gears 39 and 40 are properly set in the housing 54.

As is seen from FIGS. 5 and 8, the belt arm 15 from the endless belt 11 is secured through two bolts 12*a* to a door bracket 12 which extends from the door 2. Thus, when the endless belt 11 is moved due to energization of the motor 6, the slide door 2 is moved forward or rearward along the guide rail 3.

It is to be noted that, as is seen from FIG. 5, in assembling procedure, the belt arm 15 is temporarily fixed to the step bracket 5 by using a holding tool 16 until the belt arm 15 is actually secured to the door bracket 12. That is, until the actual connection between the belt arm 15 and the door bracket 12, the holding tool 16 is kept secured to both the belt arm 15 and the step bracket 5 through connecting bolts 16*a*.

As is seen from FIG. 5, on the lower surface of the step bracket 5, there is mounted a temporary stop switch 50 of a normally open type, which functions to stop the slide door 2 for a given small time. That is, when, due to the work of the door driving unit (A), the slide door 2 is moved in a closing direction and brought to a so-called temporary stop position near the full close front position 2B, that is, a position before the full close front position by about 25 cm, a projection 13*b* formed on the belt arm connector 13 contacts the switch 50 to induce a momentary ON condition of the same. Upon this, the power supply to the motor 6 is stopped for a given time, so that the door 2 stops at the position for a while. It is to be noted that, under this temporary stop condition, a power system for the motor 6 makes up a closed circuit which can induce a so-called "motor brake". That is, when, with the power system assuming the closed circuit, a rotor of the motor 6 is forced to rotate by an external force, the motor 6 serves as an electric generator which produces a marked resistance (viz., motor brake) against the external force. Thus, the slide door 2 assuming such stop position is prevented from making a useless sliding even when an external force is applied thereto.

As is seen from FIG. 5, on the front lower surface of the step bracket 5, there is further mounted a front belt guide 17 which has a gently curved surface against which the front oblique part 11*a* of the endless belt 11 slidably abuts. The front belt guide 17 is arranged to tension the belt 11. Designated by numeral 18 is a wire harness for the door driving unit (A), which trails over the lower surface of the step bracket 5 keeping clear of bolt openings 5*a*. Denoted by numeral 19 is an alarm device which, for safety, issues an audible alarm when the slide door 2 starts its opening or closing movement.

It is to be noted that after the door driving unit (A) is fully assembled on the lower surface of the step bracket 5 in the above-mentioned manner, the step bracket 5 is mounted on the supporting studs 1*b* (see FIG. 8) of the side sill 1*a* of the vehicle body 1. Bolts 1*c* are used for securing the step bracket 5 to the supporting studs 1*b*. After the step bracket 5 is mounted on the supporting studs 1*b*, the belt arm 15 extending from the endless belt 11 is fixed to the door bracket 12. Then, the holding tool 16 is removed from the step bracket 5 and the belt arm 15. Due to provision of the holding tool 16, the connection between the belt arm 15 and the door bracket 12 is quickly and precisely made.

As is understood from FIG. 5, when, due to movement of the endless belt 11, the belt arm connector 13 and the belt arm 15 are moved forward and come to the position of the front oblique part 11*a* of the belt 11, the belt arm 15 enters the back side of the front step portion 5*d* of the step bracket 5. Since the reinforcing channel member 5*b* has no portion extending into the front step portion 5*d*, the movement of the belt arm 15 into the back side of the front step portion 5*d* is not obstructed by the bolts 12*a*.

Referring back to FIG. 1, a door switch 48 is mounted on a front wall of the door opening of the vehicle body 1, which keeps ON condition when the door 2 takes a position between the full close front position 2B and an after-mentioned half-latch position. Denoted by numeral 20 is a manual switch unit mounted near a driver's seat. The unit 20 includes an open switch 20*a* and a close switch 20*b* (see FIG. 2). That is, by manipulating the switches 20*a* or 20*b*, the door driving unit (A) is operated to drive the slide door 2 in opening or closing direction.

That is, when the close switch 20*b* is manipulated, the alarm device 19 is instantly operated to issue an audible alarm letting the vehicle passengers know the starting of the door closing. After a while, the door driving unit (A) becomes operated, and the slide door 2 starts the closing movement. When, thereafter, the slide door 2 comes to the temporary stop position to actuate the temporary stop switch 50, the door 2 stops for a given small time. If the open switch 20*a* or the close switch 20*b* is manipulated within this given small time, the alarm device 19 is instantly operated and then the door driving unit (A) is operated to move the door 2 in opening or closing direction.

Denoted by numeral 24 in FIG. 1 is a first connector mounted on the front wall of the door opening of the vehicle body 1, and denoted by numeral 25 is a second connector mounted on a front wall of the slide door 2. These two electric connectors 24 and 25 are kept engaged to achieve an electric connection therebetween when the door 2 is in an area between the full close front position 2B and a position just before the half-latch position. Thus, when the door 2 is in such area, electric power supply from a battery 21 mounted on the vehicle body 1 to various electric parts mounted on the slide door 2 is permitted.

As is seen from FIG. 1, the slide door 2 is equipped with a door lock device 26, a door closing unit (B) and a lock canceling unit (C). The door lock device 26 can latch the slide door 2 to the vehicle body 1 when the door 2 comes to the full-close front position. The door lock device 26 has three major conditions, which are a full-latch condition wherein a latch plate of the lock device is fully engaged with a striker of the vehicle body 1, a half-latch condition wherein the latch plate is incompletely engaged with the striker and a release condition wherein the latch plate is disengaged from the striker.

The door closing unit (B) functions to enforcedly move the door 2 to the full-close front position 2B when the door 2 comes to the half-latch position. That is, when the door 2 comes to the half-latch position, the door closing unit (B) forces the latch plate of the door lock device 26 to pivot to the full-latch position.

The lock canceling unit (C) is connected to a release lever 46 of the door lock device 26 through a cable 47. The lock canceling unit (C) functions to cancel the full latch engagement between the latch plate and the striker by pulling the cable 47. Thus, when, with the slide door 2 assuming the full-close full-latch front position, the lock canceling unit (C) is operated, the latched engagement of the door 2 to the vehicle body 1 is canceled and thus thereafter the door 2 is permitted to move in the opening direction.

Figure 9:
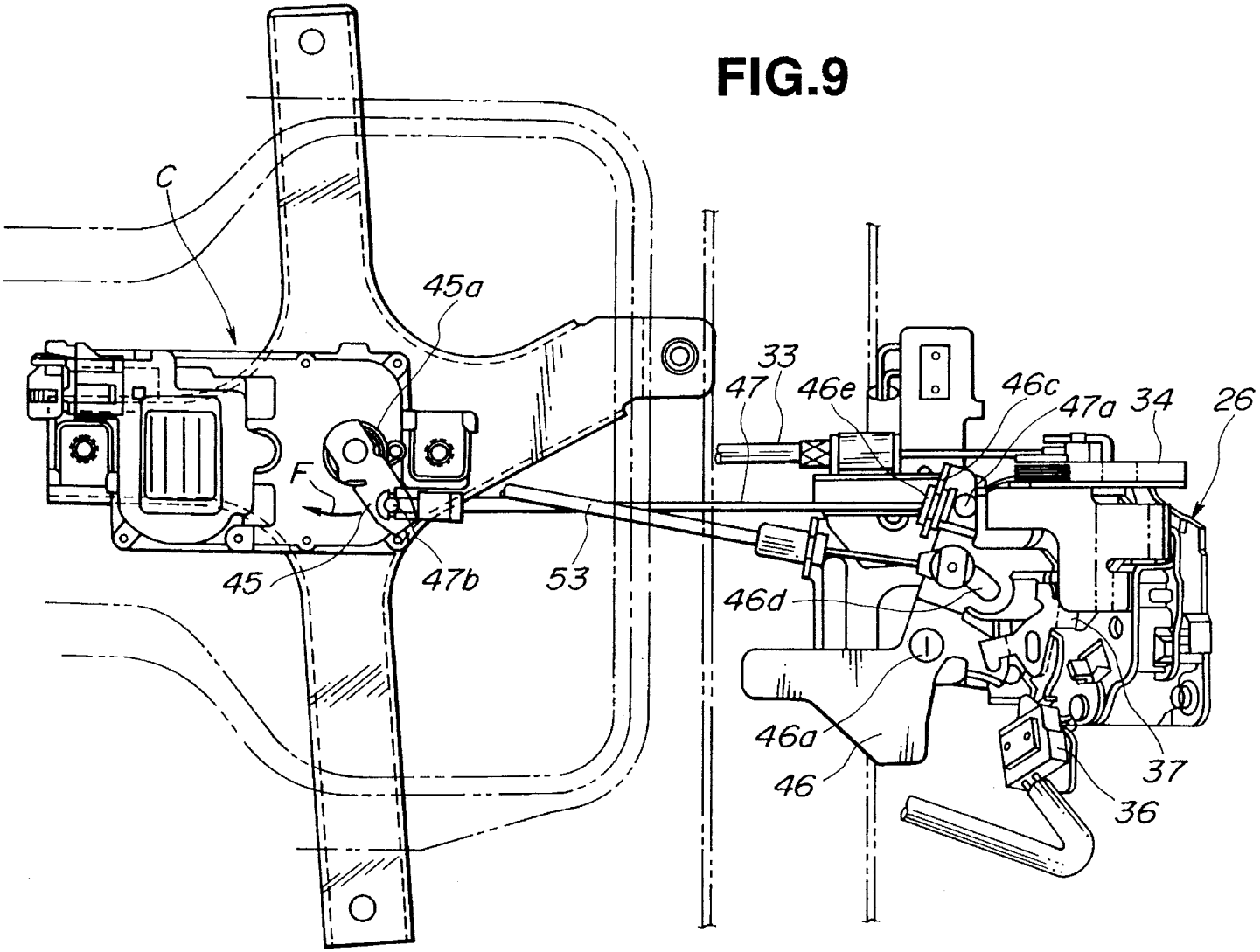
FIG. 9 is a side view of a lock canceling unit and a door lock unit.
Figure 12:
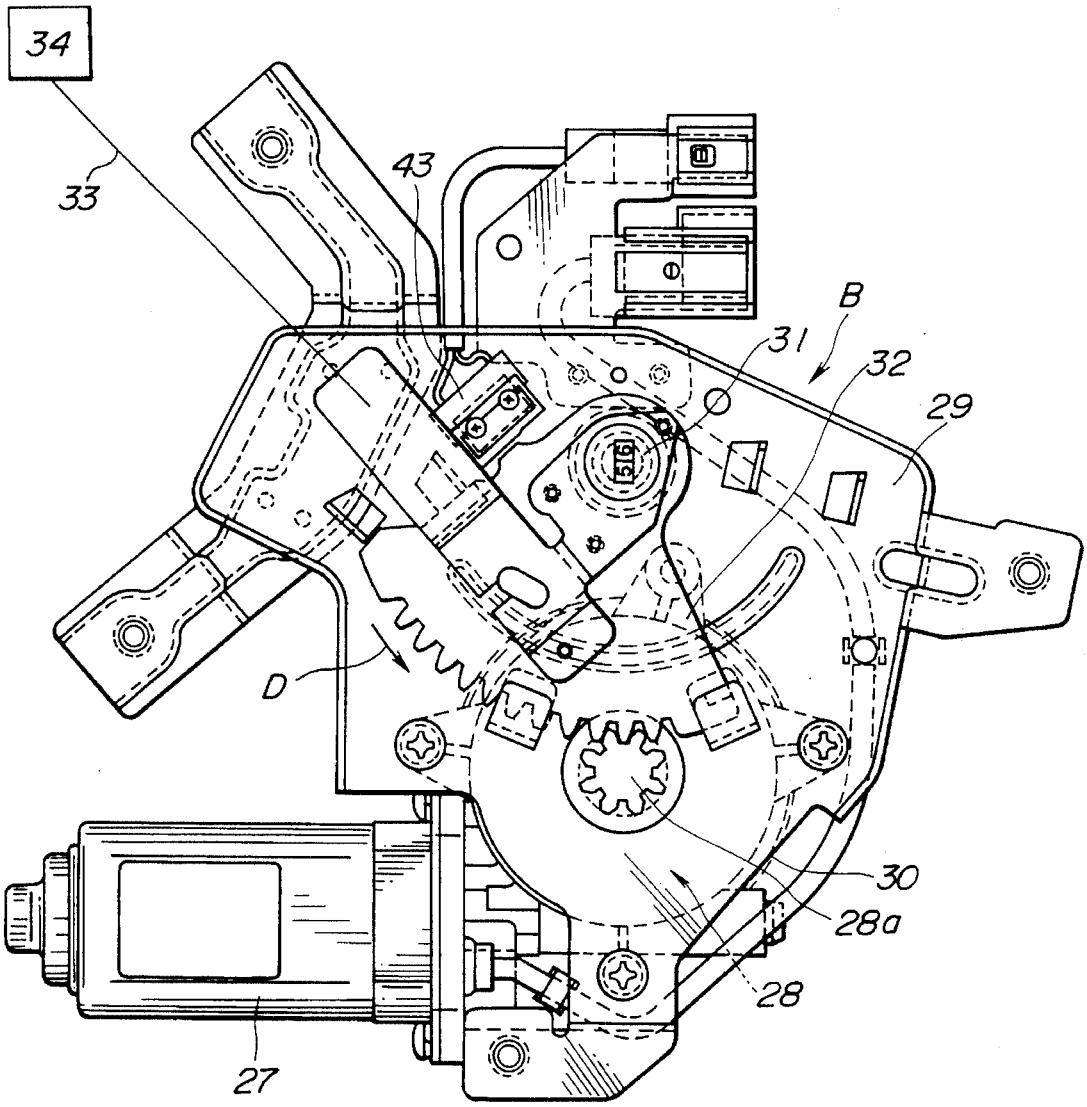
FIG. 12 is a plan view of a door closing unit.

The door closing unit (B) is shown in detail in FIG. 12. The door closing unit (B) generally comprises a base plate 29, an electric motor 27 mounted on the base plate 29, a speed reduction unit 28 mounted on the base plate 29, and a sector gear 32 pivotally connected to the base plate 29 through a shaft 31. The speed reduction unit 28 comprises a worm and a worm wheel which are installed in a housing 30. The sector gear 32 is meshed with a pinion **28*a* which is fixed to an output shaft of the speed reduction unit 28. The sector gear 32 has a cable 33 pivotally connected thereto. The cable 33 extends to a close lever 34 of the door lock device 26, as is seen from FIGS. 9 and 10. That is, when the motor 27 is energized to rotate in a normal direction, the sector gear 32 pulls the cable 33. With this pulling, the close lever 34 of the door lock device 26 is pivoted to push an arm portion 35 (see FIG. 10) of the latch plate causing the latch plate to assume the full-latch position. Thus, the door 2** can be shifted from the half-latch position to the full-latch position, that is, to the full-close, full-latch front position.

When thus the latch plate of the door lock device 26 comes to the full-latch position, a sensor switch (not shown) issues a signal and the motor 27 is thus energized to rotate in a reversed direction. Thus, the sector gear 32 of the door closing unit (B) and the close lever 34 of the door lock device 26 are returned to their original positions. Denoted by numeral 43 in FIG. 12 is an original position detecting switch which detects the original position of the sector gear 32.

Figure 10:
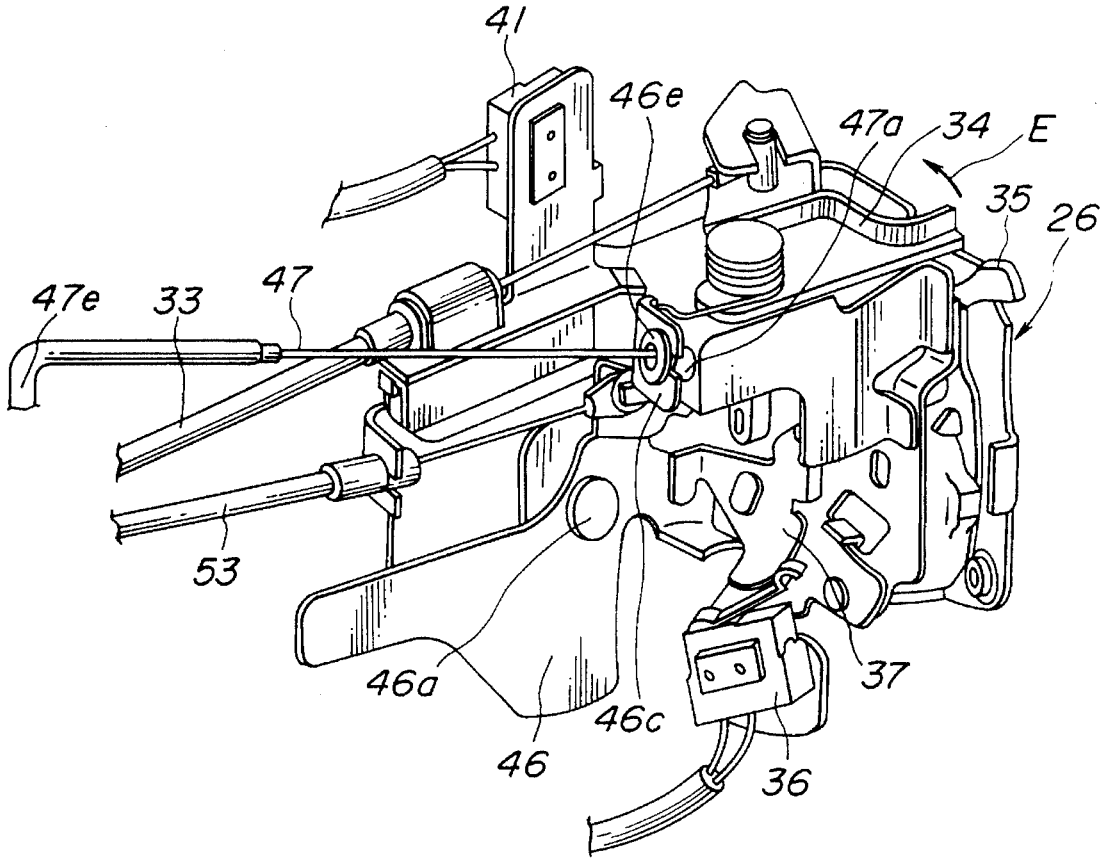
FIG. 10 is a perspective view of the door lock unit.

As is shown in FIG. 10, a half-latch condition detecting switch 36 is employed, which detects the half-latch condition of the door lock device 26 by sensing the movement of an open lever 37 of the door lock device 26 and a full-latch condition detecting switch 41 is further employed, which detects the full-latch condition of the door lock device 26 by sensing the movement of the close lever 34.

Figure 11:
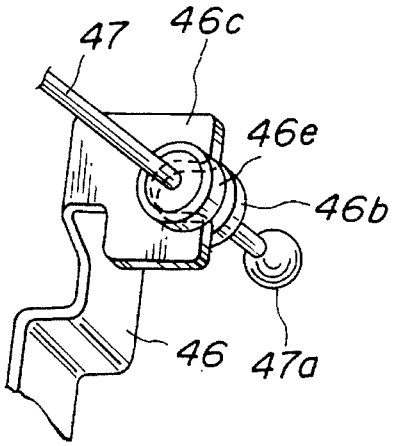
FIG. 11 is a perspective but partial view of a release lever and its associated parts.

As is seen from FIG. 10, the release lever 46 of the door lock device 26 is pivotally connected to a fixed housing member through a pivot shaft **46*a*. As is seen from FIG. 11, the release lever 46 has an upper bent lug 46*c* formed with a semicircular recess 46*b*. The release lever 46 has near the pivot shaft 46*a* an arcuate slot 46*d* (see FIG. 9**).

To the semicircular recess **46*b* of the release lever 46, there is fixed an annular cable holder 46*e* through which the cable 47 slidably passes. Denoted by reference numeral 47*a* is an end ball fixed to a terminal end of the cable 47. To the arcuate slot 46*d* (see FIG. 9) of the release lever 46, there is slidably engaged an end of a cable 53 which extends to an operation handle 52 (see FIG. 1) which is arranged on the slide door 2. As is seen from FIG. 9, the other end of the cable 47 from the release lever 46 of the door lock device 26 is pivotally connected to an output lever 45 of the lock canceling unit (C). Due to usage of the annular cable holder 46*e*, the connection of the cable 47 to the release lever 46 is easily carried out. This is very advantageous because usually the construction of the slide door 2 fails to provide the door lock device 26** with a sufficient receiving space.

Figure 2:
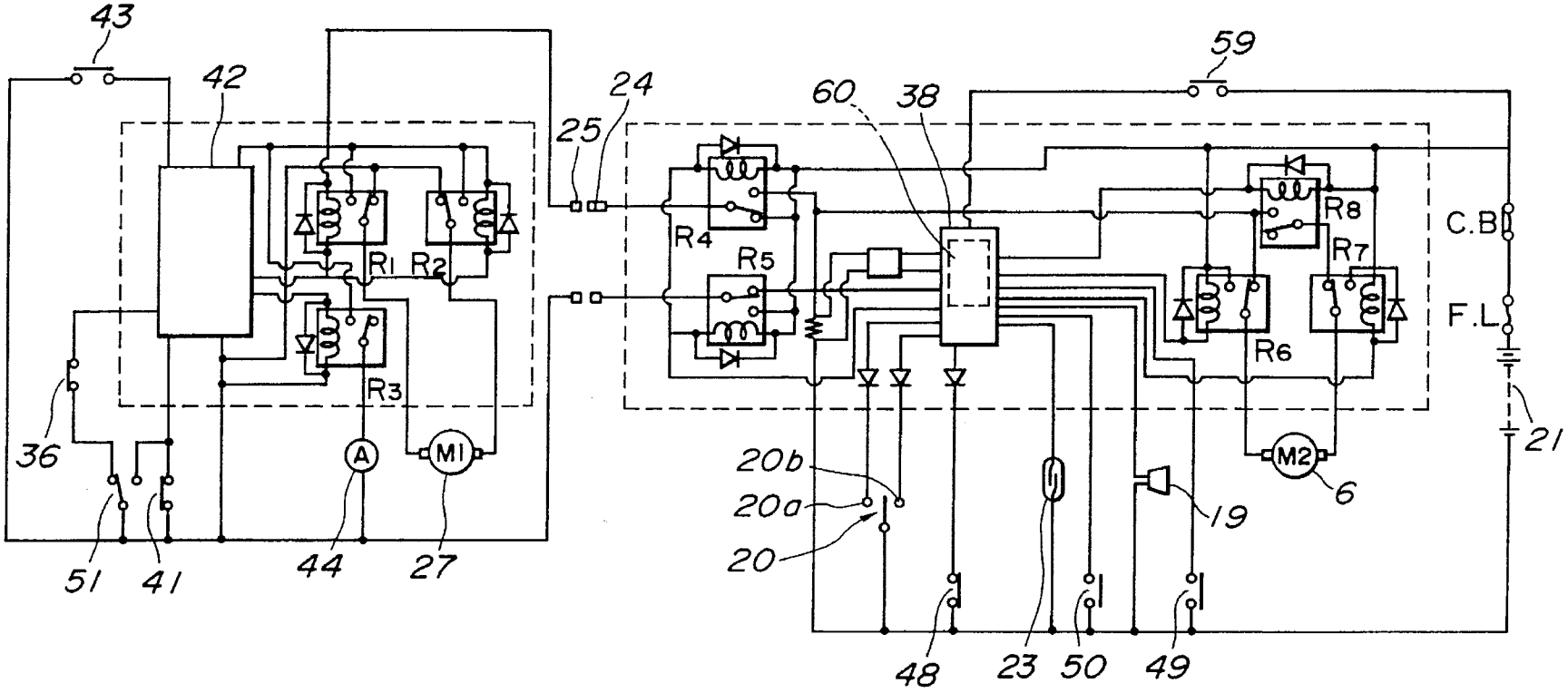
FIG. 2 is a control circuit for controlling the slide door driving system of the invention.
Figure 3:
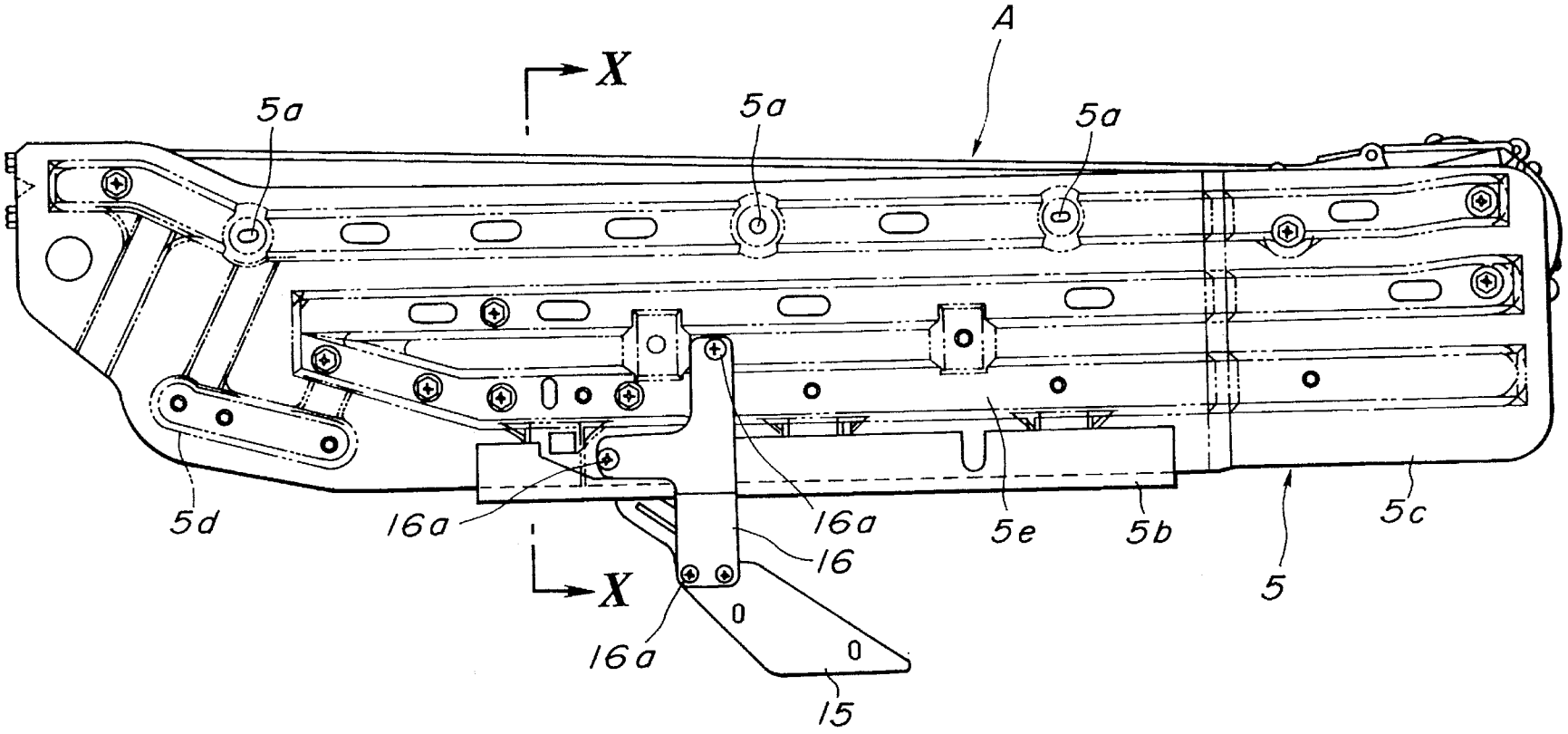
FIG. 3 is a plan view of a step bracket with some parts of a door driving unit mounted on an upper surface of the step bracket.
Figure 4:
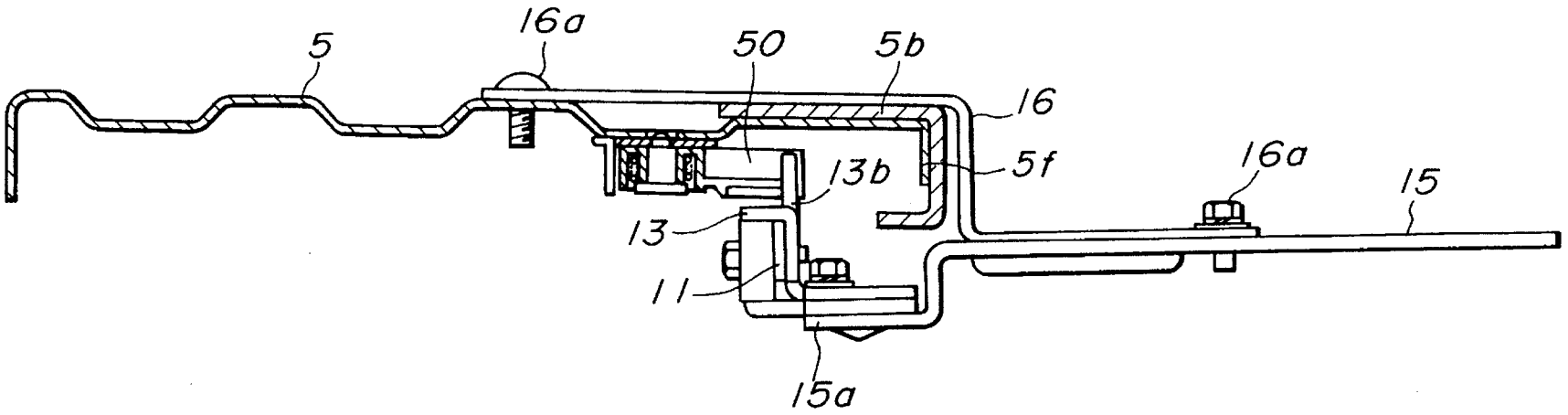
FIG. 4 is a sectional view taken along the line X—X of FIG. 3.

Referring to FIG. 2, there is shown a control circuit for the door driving system. In the circuit, denoted by numeral 21 is a battery 21 mounted on the vehicle body 1 and serving as an electric power source. 23 is a vehicle speed sensor 23 for sensing a predetermined speed of the motor vehicle, and 38 is a control unit which, in response to operation of the open and close switches **20*a* and 20*b* of the manual switch unit 20, controls the door driving unit (A) in accordance with the condition of the associated motor vehicle. The control unit 38 is provided with a judging circuit 60 therein. 42 is a control unit which controls the door closing unit (B) and the lock canceling unit (C). 44 is a motor possessed by the lock canceling unit (C) and 49 is a full open condition detecting switch which senses the full-open condition of the door 2**.

Denoted by numeral 59 is a permission switch which is interposed in series between the battery 21 and the control unit 38. The permission switch 59 is turned ON when an ignition switch (not shown) for an engine of the motor vehicle is turned ON.

References (R1) and (R2) are relays possessed by the door closing unit (B), and (R3) is a relay possessed by the lock canceling unit (C). (R6) and (R7) are relays used for controlling the motor 6 and thus the movement of the door 2. The parts of the control circuit of the door driving device (A) are connected in the illustrated manner.

The judging circuit 60 in the control unit 38 operates in the following manner.

That is, only when the permission switch 59 is kept ON, the judging circuit 60 permits the manual switch unit 20 (more specifically, the open and close switches **20*a* and 20*b*) to be operative. Thus, only when the ignition switch of the motor vehicle is kept ON, the door driving unit (A) is actually controlled by such switches 20*a* and 20*b*. Furthermore, when the permission switch 59 is kept OFF, the-judging circuit 60 permits the manual switch unit 20 to be inoperative. Thus, when the ignition switch is kept OFF, the door driving unit (A) does not operate even when the open or close switch 20*a* or 20*b* is manipulated. Furthermore, when, with the open or close switch 20*a* or 20*b* having been in ON condition, the permission switch 59 is turned ON, the judging circuit 60 does not induce an operative condition of the door driving unit (A). That is, the manual switch unit 20 is operative only when the permission switch 59** has been kept ON.

As is seen from FIG. 1, the operation handle 52 mounted to the slide door 2 is connected through the cable 53 to the release lever 46 of the door lock device 26. Thus, when, due to manipulation of the operation handle 52, the cable 53 is pulled toward the operation handle 52, the release lever 46 (see FIG. 10) pivots the open lever 37 thereby to cancel the latched engagement between the latch plate of the door lock device 26 and the striker mounted to the vehicle body 1. Thus, thereafter, the door 2 is permitted to move in opening direction. Denoted by numeral 51 is a handle switch which detects a manipulation of the operation handle 52. When the handle switch 51 detects the manipulation of the operation handle under operation of the door closing unit (B), the control circuit forces the motor 27 of the unit (B) to rotate in a reversed direction thereby to return the unit (B) to its original position. Designated by numeral 22 in FIG. 1 is a shift control lever mounted in the vehicle body 1.

In the following, operation of the slide door driving system of the present invention will be described with reference to FIG. 2.

For ease of understanding, the description will be commenced with respect to a condition wherein, the engine of the vehicle is idling, the vehicle speed sensor 23 senses a standstill condition of the vehicle and the door switch 48 senses the full open condition of the slide door 2. Under this, the permission switch 59 is kept ON.

When now the close switch **20*b* of the manual switch unit 20 is manipulated by, for example, a driver, the judging circuit 60 judges the manipulation to be operative. Thus, the alarm device 19 issues an audible alarm and, after a given small time, the control unit 38 energizes the relay (R7) to establish an electric connection between the battery 21 and the motor 6 of the door driving unit (A). Upon this, the motor 6 is rotated in a normal direction and thus the toothed endless belt 11 is moved in a direction to close the slide door 2. For safety, the alarm device 19 continues to issue the alarm while the close switch 20*b*** is kept manipulated.

When the slide door 2 comes to the temporary stop position (viz., the position before the full close front position 2B by about 25 cm), the temporary stop switch 50 momentarily operates. Upon this, the control unit 38 stops the motor 6 for a given time thereby to stop the slide door 2 at such temporary stop position for the given time. It is to be noted that under this temporary stop condition, the power system of the motor 6 makes up a closed circuit, which induces the "motor brake", so long as the close switch **20*b* is kept manipulated. That is, under this condition, the relay R8 is energized. Thus, the slide door 2** assuming such temporary stop position is suppressed from making unwilled sliding even when an external force is applied thereto.

When, after the slide door 2 stops at such temporary stop position, the close switch **20*b* is released from operator's hand and then the switch 20*b* is manipulated by the operator again, the alarm device issues the audible alarm again and instantly the motor 6 is energized to move the door 2** toward the full close front position.

When thereafter the slide door 2 comes to a position just before the half-latch position, the second connector 25 on the door 2 contacts the first connector 24 on the vehicle body 1 thereby to feed the control unit 42 with an electric power from the battery 21. When the door 2 comes to the half-latch position, the latch plate of the door lock device 26 is incompletely engaged with the striker on the vehicle body 1. This incomplete engagement is detected by the half-latch condition detecting switch 36, and thus the control unit 38 stops the power feeding to the motor 6 of the door driving unit (A).

Thereafter, the relay R1 is energized and thus the motor 27 of the door closing unit (B) is energized, so that the sector gear 32 of the unit (B) is turned in a given direction (that is, the direction of the arrow D in FIG. 12) pulling the cable 33. Thus, the close lever 34 (see FIG. 10) is pivoted in the direction of the arrow E forcing the latch plate to pivot to the full-latch position. With this, the slide door 2 is moved to the full-close full-latch front position.

When the full-latch condition detecting switch 41 thus detects the full-latch condition of the door lock device 26, the relay R2 is energized and the motor 27 is energized to rotate in a reversed direction. Thus, the sector gear 32 is returned to its original position. Upon this, the original position detecting switch 43 operates and thus the motor 27 stops. That is, parts of the door closing unit (B) are returned to their original positions.

When, with the door 2 assuming the full-close full-latch front position and with the engine being in an idling condition, the open switch **20*a* of the manual switch unit 20 is manipulated, the judging circuit 60 judges the manipulation to be operative. Thus, the relay R3 is energized to energize the motor 44 of the lock canceling unit (C). With this, the output lever 45 (see FIG. 9) of the unit (C) is pivoted in the direction of the arrow F pulling the cable 47 in the same direction. Thus, the release lever 46 and the open lever 37 of the door lock device 26 are pivoted in a direction to cancel the latched engagement between the latch plate and the striker. Upon this, due to the force of an elastic weather strip (not shown) mounted to the door 2, the slide door 2 is slightly shifted outward from the full-close full-latch front position. It is to be noted that, due to provision of the arcuate slot 46*d* with which the end of the cable 53 is slidably engaged, the pivot movement of the release lever 46 caused by the lock canceling unit (C) does not induce any movement of the cable 53. Thus, the operation handle 52 to which the cable 53 is fixed is not affected by such pivot movement of the release lever 46**.

When the door 2 is thus shifted outward to the slightly open released position, the door switch 48 operates and thus the operation of the lock canceling unit (C) stops. Upon this, the output lever 45 of the lock canceling unit (C) is returned to its original position due to the force of a biasing spring **45*a* (see FIG. 9), and then the motor 6 is energized to move the endless belt 11 in the direction to open the slide door 2. When the door 2 comes to the full-open rear position, the full open condition detecting switch 49 operates and thus the motor 6** stops.

In the following, advantages of the present invention will be described.

(1) Even if the ignition switch of the motor vehicle is turned ON under a condition wherein the open or close switch **20*a* or 20*b* of the manual switch unit 20 is in the ON position, it never occurs that the slide door 2** starts to move unexpectedly.

(2) The slide door 2 can be moved manually. Under the manual movement of the door 2, the power unit 8 is forced to rotate in a reversed direction. Of course, if the manual movement of the door 2 is intended with the electric power system kept OFF, the movement is carried out without obstruction of the motor brake. That is, in such case, the power circuit for the motor 6 constitutes an open condition.

(3) Since the substantially all parts of the door driving device (A) are mounted to the step bracket 5 before the latter is fixed to the vehicle body 1, assembly of the door driving device (A) is readily and precisely achieved.

(4) Since the belt arm 15 is tightly fixed to the step bracket 5 by the holding tool 16 before the latter is fixed to the vehicle body 1, mounting the step bracket 5 to the vehicle body 1 is readily carried out without suffering from a pivotal movement of the joint bracket 15.

(5) When the slide door 2 is brought to the half-latch position by the door driving device (A), the door driving device (A) is deenergized and the door closing unit (B) is energized for shifting the door 2 from the half-latch position to the full-latch position. Since the deenergization of the door driving device (A) and the energization of the door closing unit (B) are timingly made, the entire movement of the slide door 2 from the open rear position to the full-close full-latch front position and vice versa is smoothly carried out without wasting the electric power.

What is claimed is:

1. A slide door driving system of a motor vehicle, comprising:

an electric power source;

a door driving device to move a slide door between a full-open position and a full-close latched position with an aid of electric power from said electric power source;

a manual switch mounted in the motor vehicle;

a control circuit for controlling said door driving device in accordance with operation of said manual switch; and a permission switch connected to said control circuit and an ignition switch for an engine of the vehicle, said permission switch being turned ON when the ignition switch is turned ON;

wherein said control circuit is provided with a judging circuit which makes said manual switch operative only when said permission switch is ON.

2. A slide door driving system as claimed in claim 1, in which said door driving device comprises:

a door driving unit which drives said slide door between the full-open position and an almost close position just before the full-close latched position; and a door closing unit which shifts said slide door from said almost close position to the full-close latched position.

3. A slide door driving system of a motor vehicle, comprising:

an electric power source;

a door driving device to move a slide door between a full-open position and a full-close latched position with an aid of electric power from said electric power source;

a manual switch mounted in the motor vehicle;

a control circuit for controlling said door driving device in accordance with operation of said manual switch, said control circuit including, a door driving control unit which drives the slide door between the full-open position and an almost close position just before the full-close latched position, and a door closing control unit which shifts the slide door from said almost close position to said full-close latched position;

a first electrical connector connected to said door driving control unit and mounted on the slide door;

a second electrical connector connected to said door closing control unit and mounted on a body of the vehicle, said second electrical connector mounted on the body the vehicle for engagement with said first electrical connector when the slide door is between the full-close latched position and almost close position;

an ignition switch for an engine of the vehicle; and a permission switch connected in series between said control circuit and said power source, said permission switch turning ON in response to said ignition switch being turned ON;

wherein said control circuit is provided with a judging circuit which makes said manual switch operative only when said permission switch is ON.

* * * * *